United States Patent [19]

Brugman

[11] Patent Number: 4,608,849

[45] Date of Patent: Sep. 2, 1986

[54] BENDING APPARATUS

[75] Inventor: Johannes A. H. Brugman, Papendrecht, Netherlands

[73] Assignee: Hunter Douglas International N.V., Curacao, Netherlands

[21] Appl. No.: 679,508

[22] Filed: Dec. 7, 1984

[30] Foreign Application Priority Data

Mar. 6, 1984 [GB] United Kingdom ..... 8405858

[51] Int. Cl.[4] ..... B21D 7/02

[52] U.S. Cl. ..... 72/217; 72/150; 72/219; 72/398; 72/466

[58] Field of Search ..... 72/150, 215, 216, 217, 72/218, 219, 398, 466

[56] References Cited

U.S. PATENT DOCUMENTS

| | | | |
|---|---|---|---|
| 1,136,252 | 4/1915 | Meier | 72/219 |
| 1,534,314 | 4/1925 | Heintz | 72/398 |
| 2,044,322 | 6/1936 | Oliver et al. | 72/398 |
| 2,108,271 | 2/1938 | Samuel | 72/215 |
| 3,452,571 | 7/1969 | Sassak | 72/219 |
| 4,123,930 | 11/1978 | Hill et al. | 72/466 |

FOREIGN PATENT DOCUMENTS

| | | | |
|---|---|---|---|
| 675704 | 5/1939 | Fed. Rep. of Germany | 72/466 |

*Primary Examiner*—Francis S. Husar
*Assistant Examiner*—Jorji M. Griffin
*Attorney, Agent, or Firm*—Pennie & Edmonds

[57] ABSTRACT

Apparatus for bending a light gauge, profiled, metal panel to a curved shape, including an anvil mounted on a frame and having a part-annular surface, an arm mounted for pivotal movement about the center of curvature of the part-annular surface, a roller carried by the arm at a position spaced from the center and rotatable about its own axis, so that it can roll in an arc adjacent the annular surface, a mandrel carried by the arm for movement therewith at a location between the roller and surface, the mandrel comprising a plurality of blocks each having its length parallel to the roller axis, the blocks being juxtaposed in side-by-side relation and each shaped to conform to the profile of the panel to be bent, and at least one flexible element passing through all of the blocks and loosely holding them in juxtaposed relation, but allowing slight relative movement whereby, in use, with the mandrel engaged in the profile of a panel to be bent, the mandrel acts as a shape retaining member for the profiled panel, the mandrel moving relative to the part-annular surface.

16 Claims, 7 Drawing Figures

BENDING APPARATUS

DESCRIPTION

The present invention relates to apparatus for bending a light gauge, profiled, metal panel to a curved shape.

There are several different types of wall and ceiling panelling structure in which there are mounted on support members or stringers spaced parallel panels which are in the form of elongate profiled members of constant cross-section, this cross-section including a web and inturned rims. The rims are very often curved and can have a bead at their free ends, the rims thus forming with the web of the panel a generally channel section.

It is sometimes desirable to bend these panels about an axis which is parallel to the web of the panel and transverse to the length thereof. In this way one can provide an outside bend, that is with the web at the radially outer portion and the rims pointing radially inwardly, or one can have an inside bend, that is with the web towards the centre of curvature and the rims extending outwardly.

Various attempts have been made to bend the panels in this way but none of them has proved entirely satisfactory. Particularly if one is using a light gauge metal, such as aluminium, for example, of a thickness of 0,5 mm there is a great tendency for buckling to occur in the region of the rims and once any buckling occurs, the panel has to be thrown away.

It is now proposed, according to the present invention, to provide an apparatus for bending a light gauge, profiled, metal panel to a curved shape, said apparatus comprising a frame, an anvil mounted on said frame and having a part-annular surface, a pivot bearing on said frame located at the centre of curvature of said part-annular surface, an arm mounted on said bearing for pivotal movement about said centre, a roller carried by said arm at a position spaced from said centre and rotatable about its own axis, so that it can roll in an arc adjacent said annular surface, a mandrel acting as a shape retaining member for the profiled panel, cooperating with said arm for movement therewith at a location between said roller and said surface, said mandrel comprising a plurality of blocks each having its length parallel to the roller axis, the blocks being juxtaposed in side-by-side relation and each shaped to conform to the profile of the panel to be bent, and at least one flexible element for transferring movement of said arm to the mandrel, said flexible element passing through all of said blocks and holding them in juxtaposed relation in a way to allow slight relative movement between the blocks whereby, in use, with the mandrel engaged in the profile of a panel to be bent, the mandrel moves relative to the part-annular surface, either between the web of the panel and the roller, for an inside bend in the panel, or between a web of the panel and the anvil for an outside bend in the panel. Provision of the mandrel within the profile of the panel can prevent any uncontrolled buckling of the rims of the panel. The apparatus of the present invention is simple in construction and econcomical to manufacture. It can be very efficient in operation and does not require a skilled operator. Because of its simplicity it only requires a minimum of maintenance and is easily transportable to a building site where the panels are being installed. Once at the building site it can readily be operated quickly to bend the panel to a desired shape.

Advantageously the at least one flexible element with respect to said blocks is so arranged that a pulling force on the arm for moving the mandrel is translated into a pushing force on said mandrel blocks. Such an impartion of pushing force results in the flexible means urging the mandrel members towards the anvil, thereby anticipating and neutralising the panel deforming forces.

Preferably there is a mechanical connection between the arm and the mandrel.

In one particular construction, the arm carries a bridge extending over the part-annular surface and the mandrel is connected to the bridge, to be pulled thereby as the arm is moved to bend the panel. The bridge may be carried by levers which are pivotally mounted on the arm to facilitate the insertion of the panel before bending.

In order to guide the panel correctly as it is inserted, a cranked rod is preferably mounted between the levers and carries a guide roll which is adapted to engage the exterior surface of the web of a profile of a panel to be bent.

It is necessary to hold the panel at a portion which is not being bent and the apparatus advantageously includes a clamp positioned to hold the panel against the anvil adjacent the first part of a panel to be bent by the apparatus, and the mandrel is of length to extend back from the bridge to a position short of the clamp. Because it is short of the clamp it will not be held by the clamp and thereby prevent it moving together with the roller as the arm is moved.

For best retaining of the shape, the mandrel should extend as far back, relative to the movement of the roller, as possible. It should, however, not extend back to within the clamp. Preferably, therefore, the connection between the bridge and the mandrel is a lost-motion connection, such that the mandrel does not begin to move until the roller has moved away from the zone of the clamp. This enables the bending operation to start before the mandrel itself starts to move and thereafter allows the mandrel to extend back by an adequate amount.

During movement of the mandrel with the roller, the point of contact of the roller with the panel, or with the mandrel, preferably is and remains substantially at the centre of width of a single one of the blocks of the mandrel so that that block will adequately hold the panel, whereas, had the point of contack of the roller been over the gap between two blocks, then the blocks would tend to tip and would in fact tend to distort the panel.

Th width of the blocks and the length of the lost motion permitted by the connection is advantageously so chosen that when the roller starts its movement, the point of contact of the roller with the panel or mandrel is substantially at the centre of width of another of the blocks. Thus, at the very start of the bending motion, before the mandrel starts moving, the centre of pressure is at the centre of width of one of the blocks.

The roller is preferably mounted between bars pivotally mounted on the arm, to allow a panel to be inserted and removed, and means are provided to lock the bars relative to the arm during pivotal movement of the arm. This facilitates the introduction and removal of a panel but ensures that the roller is correctly positioned during pivoting of the arm.

The flexible elements of the mandrel may be in the form of wires and an adjustable stop is preferably provided on the or each wire to enable the clearance between adjacent blocks of the mandrel to be adjusted. Normally the smaller the radius of curvature of the bend in the panel, the larger will be the clearance. Preferably the blocks are, at least along the circumference of their confronting surfaces, mutually held at a small distance, e.g. by integral or separate distance pieces or parts. Alternatively, and dependable a.o. on material used for the panels, cavities may be provided at the outer edges of each block at the face adjacent the next block to allow the rims of the panel being bent to buckle slightly thereinto during the bending of an outside bend.

In order to ensure good sliding motion of the mandrel relative to the length of the panel, the blocks are preferably formed of a low friction plastics material. The mandrel blocks may each be formed on one face with a recess, providing a parallel sided groove along one surface of the mandrel in which a smaller cross-section profile can be fitted, so that it can be bent by the apparatus. One could conceive of providing a further smaller mandrel within the smaller cross-section panel (which would be used to joint two normal panels) and this is usually not necessary.

An adjustable fence may be provided against which the end of the panel to be bent can be abutted, thereby determining the position on the panel at which the bend is to be effected. Similarly, an adjustable stop may be provided to limit the pivotal movement of the arm and thus the length of the bend formed.

Desirably, the effective length of the arm and the radius of curvature of the curved surface of the anvil can be varied correspondingly, to enable bends of different radii of curvature to be formed.

For example, the arm may be provided with two spaced bearings to give two different distances between the bearing and the roller and two cooperating anvils may also be provided, the arrangement being such that bends of two different radii of curvature may be formed on the panels. This is particularly important where one puts an inside bend on one panel and an outside bend on another panel and the two panels are designed to interlock with one another.

In order that the invention may more readily be understood, the following description is given, merely by way of example, reference being made to the accompanying drawings, in which.

Figure 1:
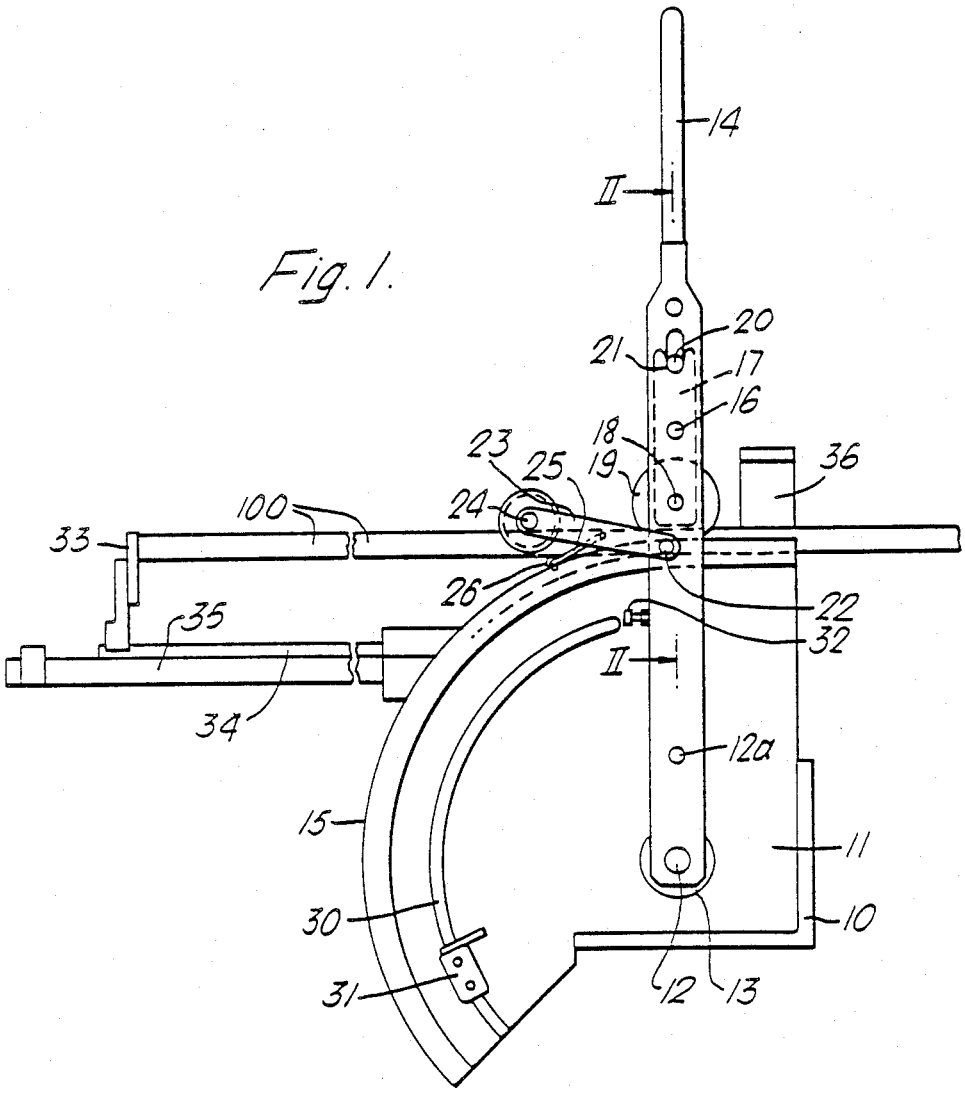
FIG. 1 is a side elevation of one embodiment of bending apparatus accordin9 to the invention, with the arm and panel in the starting position.
Figure 2:
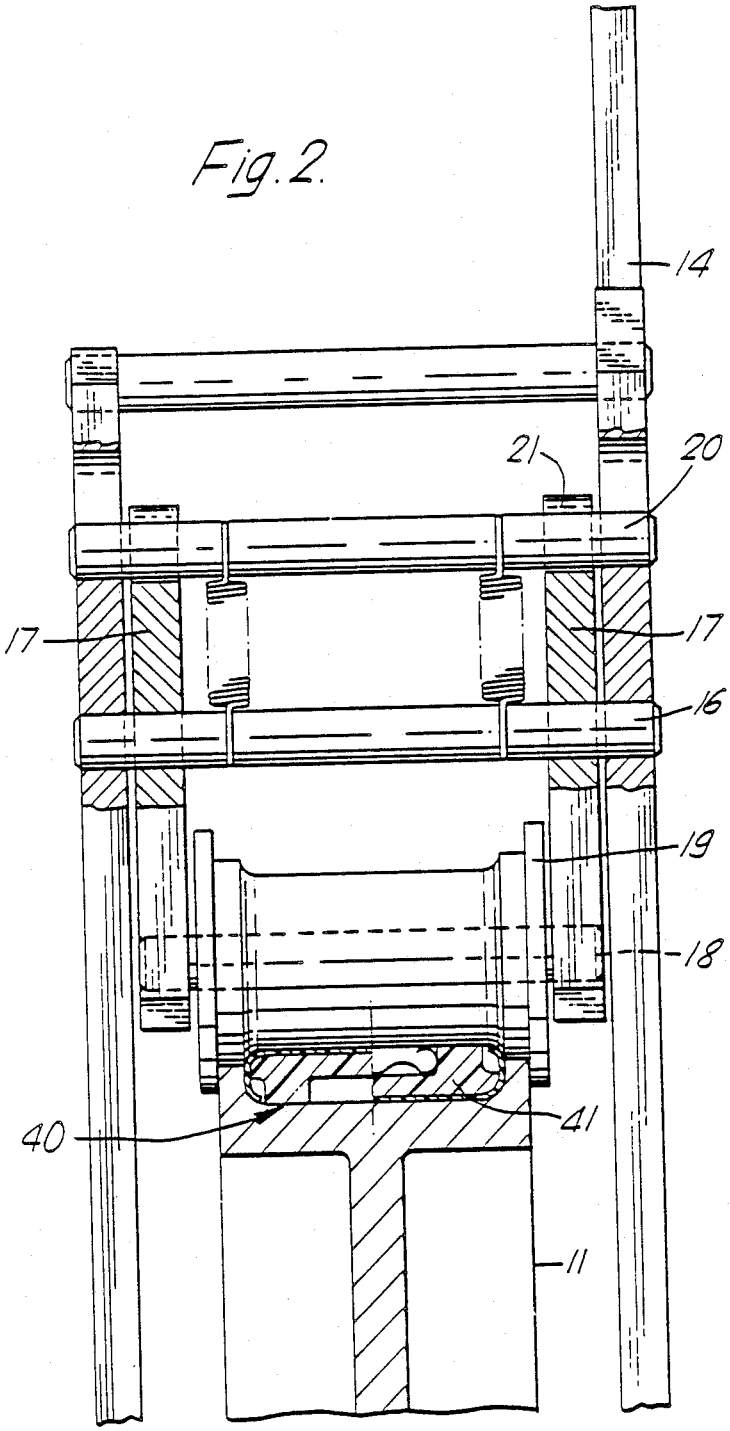
FIG. 2 is a transverse sectional view taken along the line II—II in FIG. 1.

Referring first to FIG. 1, the apparatus illustrated therein comprises a frame 10 in the form of an angled bracket which may be secured to a bench, the frame having mounted thereon an anvil 11 provided with a bearing (not shown) for a shaft 13. The shaft 13 has mounted thereon a further bearing 12 adjacent the lower end of an arm 14 which can thus be pivoted about the shaft 13.

Pivotally mounted on the arm 14, about an axis 16, is a pair of bars 17 which carry therebetween, on an axis 18, a bending roller 19. The position illustrated in FIG. 1 of the bars 17 is maintained by a spring-loaded locking element 20 which engages in a notch 21 at the top of each bar 17. The locking element 20 can be raised to allow disengagement so that the bars 17 can pivot about the axis 16, thus lifting the roller 19 away from the part of the part-annular surface 15.

Again, pivotally mounted on the arm 14 about axis 22 are a pair of levers 23 having extending therebetween a bridge 24 which overlies the part-annular surface 15. The levers 23 also carry therebetween a cranked rod 25 can rockably pivot relative to the lever 23, the cranked portion carrying a guide roll 26.

Concentric to the part-annular surface 15 is a part-annular track 30 in which is slidable a movable stop 31 which can determine the angular movement through which the arm 14 can be pivoted. A fine adjustment of this movement can be controlled by a threaded abutment bolt 32.

Also mounted on the frame is an adjustable fence 33, the position of which to the left or right of that illustrated can be controlled and locked, and the position read off a scale 34 on a support member 35.

To the right of the arm when in the starting position illustrated in FIG. 1 is a clamp 36 which includes a block unlike the profile and a movable member. In this way one can decide the angle through which one wishes to effect the bend and adjust the stop 31 and the bolt 32 accordingly and one can decide the position at which one wishes the bend to be started, and adjust the fence 33 accordingly. The locking element 20 is then disengaged to allow the bars 17 together with the roller 19 to pivot somewhat in a clockwise direction, and then one can insert through the clamp 36 the panel 100 until it abuts the fence 33. One can then tighten the clamp 36 onto the panel.

The bridge 24 has attached thereto, a mandrel indicated by the general reference numeral 40, this consisting of several plastics material blocks 41 arranged in side-by-side juxtaposed relation. A holder 42 is abutted against the end block 41 and has extending therefrom a tongue 43 having a slot 44. Engaged in the slot is an element 45 carried by the bridge 24 to allow a lost-motion connection between the mandrel 41 and the bridge 24.

The several blocks of the bridge extend with their length parallel to the axis of shaft 13 and the blocks have a cross-section conforming to the interior cross-section of a panel to be bent. There is also formed in the upper surface of each block a recess 49 thereby forming a parallel-sided groove 50 in the upper surface of the mandrel. The blocks are held in together by two flexible elements in the form of wires 46 having heads 48 engaged against the righthand block 41, the blocks being held in loose juxtaposed relation by an adjustable stop 47 engaged against the outer surface of the holder 42. This arrangement allows the blocks to move slightly relative to one another in a direction generally parallel to the length of the wires 46. Thus, the mandrel as a whole can conform roughly to the shape of the part-annular surface 15. Small cavities 51 are provided at the outer edges of each block at the face of the block abutting the ad]acent block to allow the rims of the panel to buckle slightly thereinto to the formation of an outside bend.

Figure 3:
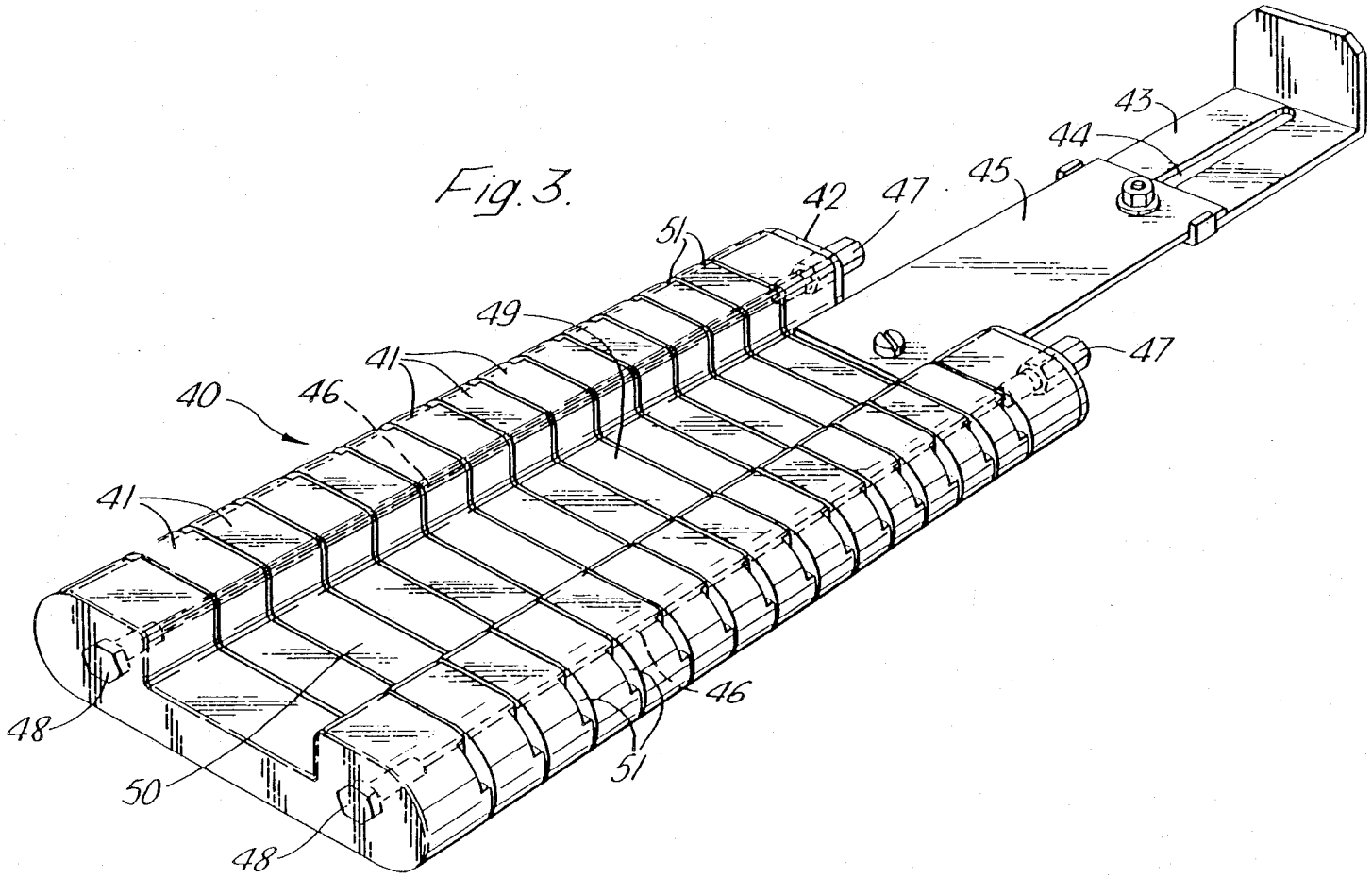
FIG. 3 is a perspective view of the mandrel.
Figure 4:
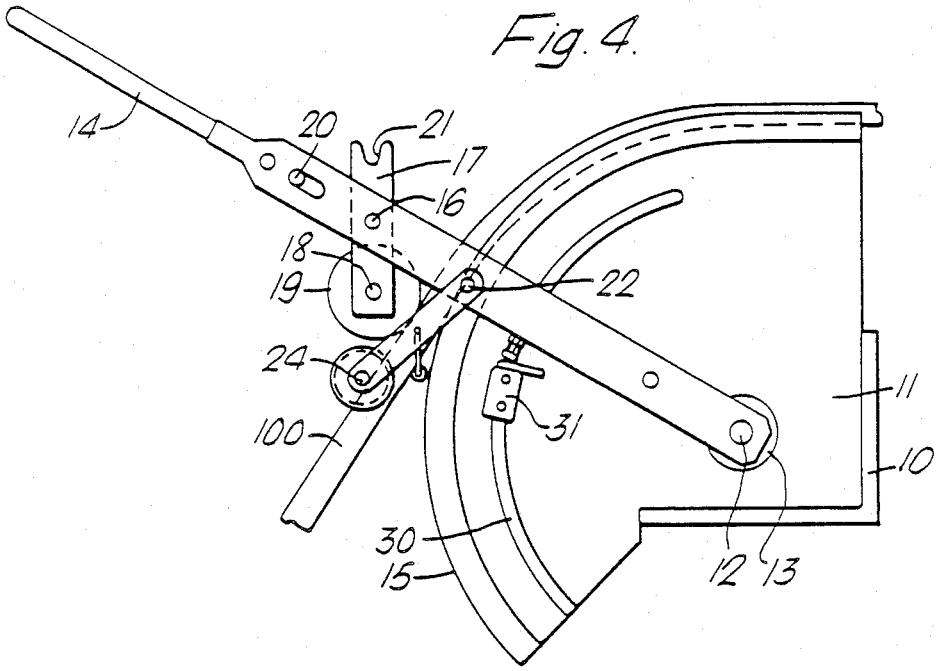
FIG. 4 is a side elevation of the apparatus of FIG. 1 with the arm in an end position and the roll disengaged after the bending of a panel has bee completed.

With the mandrel mounted on the bridge 24, as a workpiece or panel to be bent is inserted from the right, in FIG. 1, it can be passed so that the mandrel is within the confines of the panel. The panel can have its web portion 101 uppermost, that is furthest from the axis of the shaft 13 and as it slides into the apparatus, the upper surface of the web 101 will run under the guide roll 26 until the panel 100 engages the fence 33. The blocks of the mandrel will then all have been pushed to the left by the insertion of the panel, so that the arrangement of the element 45 is the slot 44 will be as shown in FIG. 3. The righthandmost block of the mandrel will then be positioned short of the clamp 36, that is to the left as seen in FIG. 1.

The operator then moves the bars 17, together with the roller 19, so that they take up the position illustrated in FIG. 1 and they are held in this position by the lock 20 engaging in the notches 21. The clamp 36 is then tightened up. In this position, the lowermost portion of the roller 19 will be engaged on the outer surface of the web of the panel 100 and it will be positioned directly above the lateral centre of one of the blocks 41 of the mandrel 40.

The arm 14 is then pulled in an anti-clockwise direction and it will then start to bend the panel to conform to the shape of the part-annular surface 15. During this initial movement, the roller will move relative to the mandrel which itself will not move until the element 45 engages the lefthand end of the slot 44. At this moment, the roller will again be above the centre of one of the blocks 41. There will still be three or four blocks to the left of this one block. Continued movement to the left will continue to bend the panel and it will also cause the mandrel itself to move with the arm, so that the mandrel is always located within the panel on either side of the point of bending caused by the movement of the roller 19 and the effect of the part-annular surface 15 of the anvil. The movement of the mandrel is achieved by the wires pulling the right-hand- most block 41, which pushes the block to its left. Since the wires are attempting to form a straight line, this, together with the pushing action, will force the individual blocks radially inwardly, thus assisting in the shaping of the panel. This movement will continue until the arm is prevented from moving further by the stop 31. Thereafter the lock 20 can be released and the arm moved back to the position illustrated in FIG. 1.

The clamp can then be undone and the bent panel removed.

The thus formed panel has an external curve on it and the provision of the mandrel which is itself capable of taking up the general form of the final curve, will prevent any buckling of the rims of the panel.

If one wishes to produce an internal curve, then the panels to be bent is inserted so that its web is below the mandrel 40 and so that it rides over the guide roll 26. The operation is substantially the same as before, but in this instance the forming roller 19 runs directly on the blocks of the mandrel. The mandrel is, however, still in position within the profile to maintain its shape.

The purpose of the groove 50 formed by recesses 49 is to enable a smaller profiled panel to be bent, the panel being inserted within this groove and between the bending roller and the base of the groove. Thus the anvil is only acting as a guide for the mandrel blocks, the base of the groove then itself acting as an anvil. The smaller panel is not subjected to the same stresses and the mandrel will have an embracing effect on it to maintain its rims in their correct position. It is also contemplated that one could fit a further smaller mandrel within the smaller profile. Such smaller profiles may be used to connect the larger profiles together.

In certain circumstances, one may wish to change the radius of curvature of the bend and for this reason the arm has been provided with a second bearing **12*a* so that the distance between the second bearing and the roll 19 is less than the first bearing 12. In these circumstances one would have to employ an anvil having a smaller radius of curvature for its surface 15**.

Figure 5:
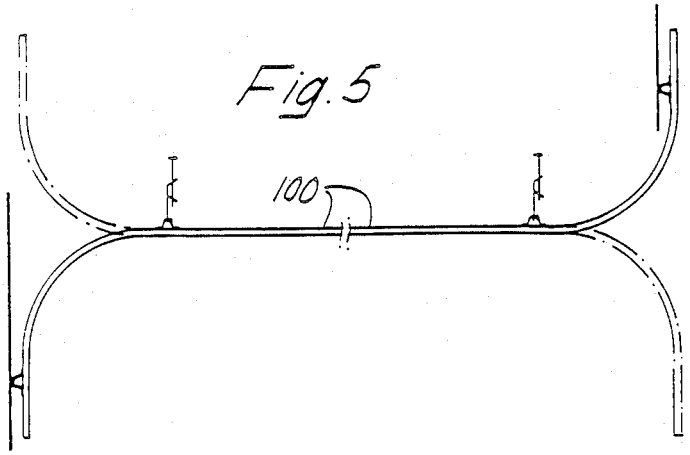
FIG. 5 shows four different configurations of panels after having been bent with the apparatus of the invention.
Figure 6:
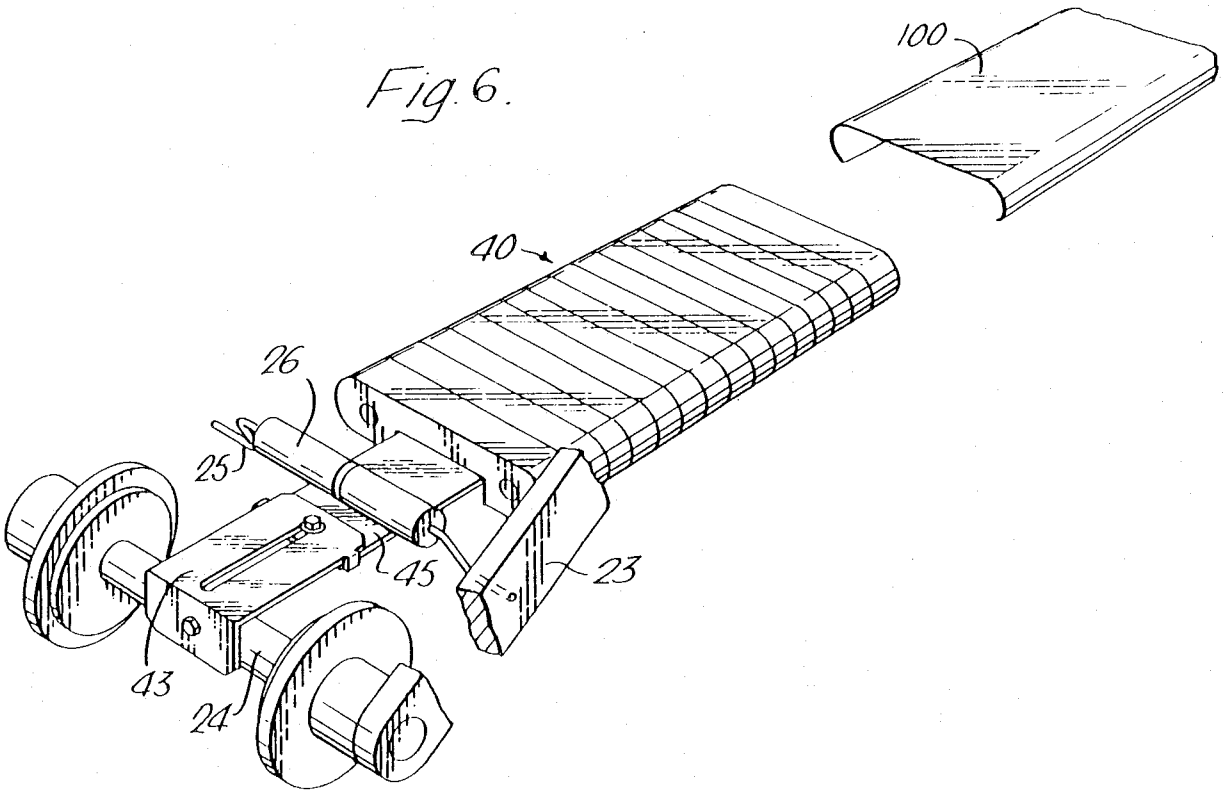
FIG. 6 shows the mandrel and guide roll in position for bending cutside corners and FIG. 7 shows the mandrel and guide roll in position for bending inside corners and joint profiles.
Figure 7:
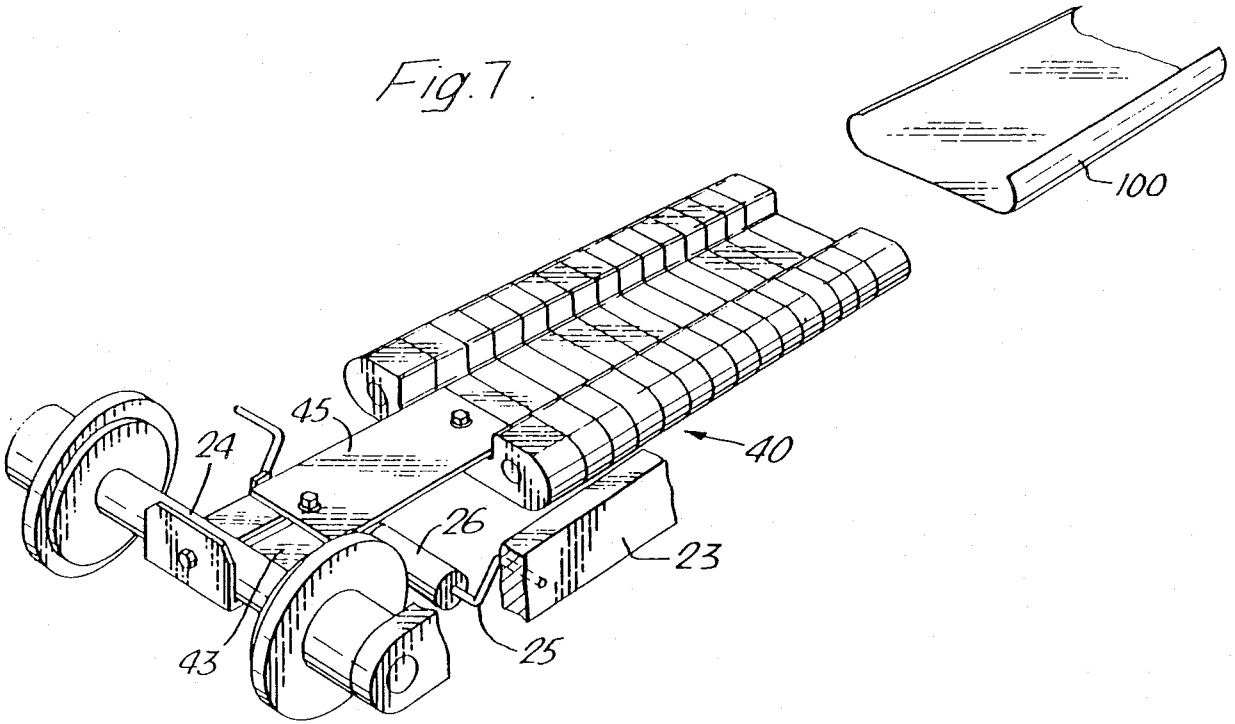

FIG. 5 shows in full lines a panel formed with one internal and one external bend. In phantom are shown further internal and external bends. Any combination of these, one at each side, can be employed, for instance two external or one of each.

I claim:

1. Apparatus for bending a light gauge, profiled, metal panel to a curved shape, said apparatus comprising a frame, an anvil mounted on said frame and having a part-annular surface, a pivot bearing on said frame located at the centre of curvature of said part-annular surface, an arm mounted on said bearing for pivotal movement about said centre, a roller carried by said arm at a position spaced from said centre and rotatable about its own axis, so that it can roll in an arc adjacent said annular surface, a mandrel acting as a shape retaining member for the profiled panel, cooperating with said arm for movement therewith at a location between said roller and said surface, said mandrel comprising a plurality of blocks each having its length parallel to the roller axis, the blocks being juxtaposed in side-by-side relation and each shaped to conform to the profile of the panel to be bent, and at least one flexible element for transferring movement of the arm to the mandrel, said flexible element passing through all of said blocks and holding them in juxtaposed relation in a way to allow slight relative movement between the blocks whereby, in use, with the mandrel engaged in the profile of a panel to be bent, the mandrel moves relative to the part-annular surface, either between the web of the panel and the roller, for an inside bent in the panel, or between a web of the panel and the anvil for an outside bend in the panel.

2. Apparatus according to claim 1, wherein the at least one flexible element with respect to the blocks is so arranged that a pulling force on the arm for moving the mandrel is translated into a pushing force on said mandrel blocks.

3. Apparatus according to claim 1 or 2, wherein during movement of the mandrel with the roller, the point of contact of the roller with the panel or mandrel is and remains substantially at the centre of width of a single one of the blocks of the mandrel.

4. Apparatus for bending a light gauge, profiled, metal panel to a curved shape, said apparatus comprising a frame, an anvil mounted on said frame and having a part-annular surface, a pivot bearing on said frame located at the center of curvature of said part-annular surface, an arm mounted on said bearing for pivotal movement about said center, a roller carried by said arm at a position spaced from said center and rotatable about its own axis, so that it can roll in an arc adjacent said annular surface, a mandrel acting as a shape retaining member for the profiled panel, cooperating with said arm for movement therewith at a location between said roller and said surface, said mandrel comprising a plurality of blocks each having its length parallel to the roller axis, the blocks being juxtaposed in side-by-side relation and each shaped to conform to the profile of the panel to be bent, and at least one flexible element for transferring movement of the arm to the mandrel, said flexible element passing through all of said blocks and holding them in juxtaposed relation in a way to allow slight relative movement between the blocks whereby, in use, with the mandrel engaged in the profile of a panel to be bent, the mandrel moves relative to the part-annular surface, either between the web of the panel and the roller, for an inside bent in the panel, or between a web of the panel and the anvil for an outside bend in the panel, wherein the connection between the arm and the mandrel is a lost motion connection, such that the mandrel does not begin to move until the roller has moved away from the zone of the clamp.

5. Apparatus according to claim 4, wherein the at least one flexible element with respect to the blocks is so arranged that a pulling force on the arm for moving the mandrel is translated into a pushing force on said mandrel block.

6. Apparatus according to claim 4, wherein during movement of the mandrel with the roller, the point of contact of the roller with the panel or mandrel is and remains substantially at the centre of width of a single one of the blocks of the mandrel.

7. Apparatus according to claim 6, wherein the width of the blocks, and the length of the lost motion permitted by said connection is so chosen that when the roller starts its movement, the point of contact of the roller with the panel or mandrel is substantially at the centre of width of another of said blocks.

8. Apparatus according to any one of th claims 1, 2, 7, 4, 5 or 6, wherein the arm carries a bridge which is carried by levers pivotally mounted on said arm, the bridge extending over said part annular surface and wherein said mandrel is connected to said bridge, to be pulled thereby as the arm is moved to bend the panel.

9. Apparatus according to claim 8, wherein a cranked rod is mounted to extend between said levers at a location between the bridge and the point of pivoting of each lever, the cranked rod carrying a guide roll adapted to engage the exterior surface of the web of the profile of the panel to be bent.

10. Apparatus according to claim 7 and further comprising a clamp positioned to hold the panel against the anvil, adjacent the first part of the panel to be bent by the apparatus and wherein the mandrel is of a length to extend back from the bridge to a position short of the clamp.

11. Apparatus according to any one of the claims 1, 2, 7, 10, 4, 5 or 6 wherein said at least one flexible element comprises a wire passing through the blocks forming the mandrel, and wherein an adjustable stop is provided on the or each wire, to enable the clearance between adjacent blocks of the mandrel to be adjusted.

12. Apparatus according to claim 1, wherein the blocks, at least along the circumference of their confronting surfaces, are mutually held at a small distance e.g. by integral or separate distance pieces or parts.

13. Apparatus according to any one of claims 1, 2, 7, 4, 5, or 6. wherein cavities are provided at the outer edges of each block at the face adjacent the next block, to allow the rims of the panel being bent to buckle slightly thereinto during the bending of an outside bend.

14. Apparatus according to claim 13, wherein the blocks of the mandrel are each formed, on one face, with a recess, providing a parallel sided groove along one surface of the mandrel in which a smaller cross-section profile can be fitted, so that it can be bent by the apparatus.

15. Apparatus according to claim 1, wherein the effective length of the arm and the radius of curvature of the curved surface of the anvil can be varied correspondingly, to enable bends of different radii of curvature to be formed.

16. Apparatus according to claim 15, wherein two anvils are provided having different radii of curvature corresponding to said two different distances, to enable bends of two different radii of curvature to be formed on panels to be bent.

* * * * *

UNITED STATES PATENT AND TRADEMARK OFFICE

CERTIFICATE OF CORRECTION

PATENT NO. : 4,608,849

DATED : Sep. 2, 1986

INVENTOR(S) : Johannes A. H. Brugman

It is certified that error appears in the above-identified patent and that said Letters Patent is hereby corrected as shown below:

On the title page at [73] Assignee: line 2 "Curacao, Netherlands" should read --Curacao, Netherlands Antilles--.

Signed and Sealed this

Twelfth Day of April, 1988

*Attest:*

DONALD J. QUIGG

*Attesting Officer*

*Commissioner of Patents and Trademarks*